United States Patent [19]

Shida

[11] Patent Number: 4,791,457

[45] Date of Patent: Dec. 13, 1988

[54] REPRODUCING APPARATUS HAVING MANUAL PAPER FEED FUNCTION

[75] Inventor: Toshio Shida, Hachioji, Japan

[73] Assignee: Konishiroku Photo Industry Co., Ltd., Tokyo, Japan

[21] Appl. No.: 21,418

[22] Filed: Mar. 4, 1987

[30] Foreign Application Priority Data

Mar. 11, 1986 [JP] Japan ..... 61-53005

[51] Int. Cl.[4] ..... G03G 21/00; B65H 3/06

[52] U.S. Cl. ..... 355/3 SH; 271/9; 271/119; 271/245

[58] Field of Search ..... 355/3 SH, 14 SH; 271/9, 271/21, 22, 118, 119, 245

[56] References Cited

U.S. PATENT DOCUMENTS

| | | | |
|---|---|---|---|
| 4,023,792 | 5/1977 | Punnett et al. | 271/118 X |
| 4,383,756 | 5/1983 | Hanamoto et al. | 355/14 SH X |
| 4,394,008 | 7/1983 | Sugiyama | 271/118 X |
| 4,579,328 | 4/1986 | Hagihara et al. | 271/119 X |
| 4,586,813 | 5/1986 | Ide | 355/3 SH X |
| 4,606,536 | 8/1986 | Ohara | 271/118 |
| 4,666,281 | 5/1987 | Miyai et al. | 355/3 SH |

*Primary Examiner*—Fred L. Braun

*Attorney, Agent, or Firm*—Frishauf, Holtz, Goodman & Woodward

[57] ABSTRACT

A reproducing apparatus having a manual paper feed function, wherein a passage for a manually inserted paper is formed below paper feed rollers, a leading end regulating member is disposed downstream of the passage for regulating the leading end of the manually inserted paper, and the regulating member is energized by an energizing member associated with the operation of the paper feed rollers before the paper feed. The paper feed rollers are formed into a semicircular shape and the energizing member is a semicircular cam fixed on the shaft of the paper feed rollers and inverted from the paper feed rollers.

20 Claims, 2 Drawing Sheets

REPRODUCING APPARATUS HAVING MANUAL PAPER FEED FUNCTION

BACKGROUND OF THE INVENTION

1. Field of the Invention

The present invention relates to a reproducing apparatus having a manual paper feed function.

2. Description of the Prior Art

In a paper feed mechanism of a reproducing apparatus, generally speaking, a paper backing plate in a cassette accommodating a sheaf of paper is raised, and a recording paper is fed sheet by sheet by the rotation of a paper feed roller of semicircular shape disposed above the cassette and the function of pawls provided in the cassette. Further, such a device in which a manual paper insertion function is added by using an upper cover is also publicly known.

In case that the manual paper insertion function is added to a paper feed mechanism of the most simple construction, it is necessary to provide a position regulating member for regulating a position of manual insertion paper at a position substantially similar to the position of the pawls of the cassette in the paper feed direction. Further, it is necessary to release the position regulating member at a predetermined timing when the paper feed roller is rotated.

In general, the position regulating member is released by an electric signal from a solenoid. However, such a construction is costly. Further, in such a system, that the position regulating member is made as a unit with the paper feed roller, so that the former is released at the same time of the paper feed. This functioning can be carried out with low cost, but it has such a defect that a position at which the position regulating member is mounted depends on the arrangement of the paper feed roller.

Specifically, in case that a somewhat thick paper, such as a postcard is fed, it is necessary to separate the pawls and the paper feed roller in the cassette from each other in the paper feed direction. In such case, the position regulating member also separates from the pawls so that it is not suitable for the regulation of the lead end of the manually inserted paper. As stated above, the system wherein the paper feed roller and the regulating member are made as a unit is simple but it lack utility.

SUMMARY OF THE INVENTION

In view of the above-specified points, an object of the present invention is to provide a reproducing apparatus which can simplify a paper feed mechanism having a manual insertion function to ensure proper paper feed.

In order to achieve the above-specified object, according to the present invention, there is provided a reproducing apparatus having a manual paper feed function, comprising: a passage for a manually inserted paper formed below paper feed rollers; a leading end regulating shutter disposed downstream of said passage for regulating the leading end of said manually inserted paper; and energizing means associated with the operation of said paper feed rollers for causing said shutter to escape before the paper feed.

Other objects and features of the present invention will become apparent from the following description to be made with reference to the accompanying drawings.

DESCRIPTION OF THE PREFERRED EMBODIMENT

Figure 1:
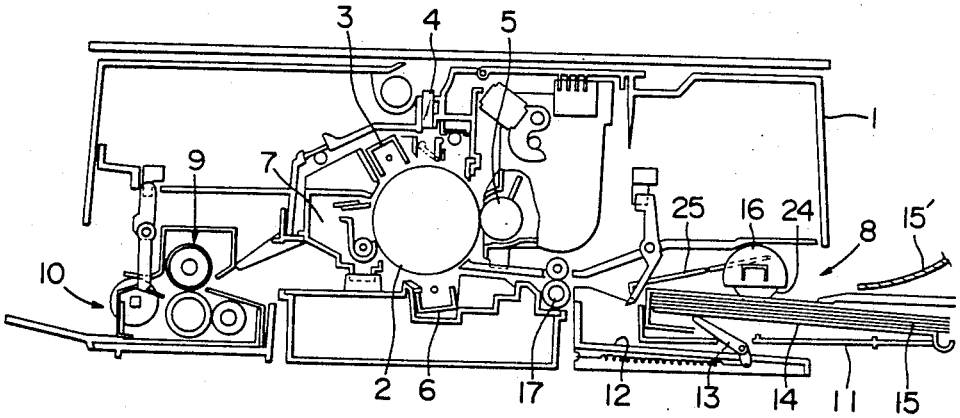
FIG. 1 is a sectional view showing a reproducing apparatus.

FIG. 1 is a sectional view showing the apparatus of the present invention. In FIG. 1, reference numeral 1 denotes a body, a numeral 2 denotes a photosensitive drum disposed in the body 1. Around the photosensitive drum 2, there are arranged a charging unit 3, an exposing lens unit 4, a developing unit 5, a transfer unit 6 and a cleaning unit 7. Numerals 8, 9 and 10 denote a paper feed unit, a fixing unit and a paper discharge unit, respectively.

The paper feed unit 8 is equipped with: paper feed rollers 16 for feeding out recording paper 15, which is raised by lifting a paper backing plate 14 in a cassette 11 by a push-up level 13 arranged on the bottom of a cassette loading unit 12; and second paper feed rollers 17 for clamping the recording paper 15 feed from said paper feed rollers 16 to convey it to the aforementioned transfer unit 6 in accordance with a predetermined timing.

Figure 2:
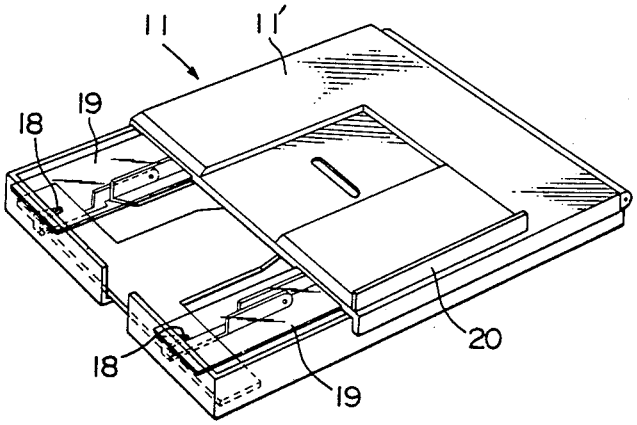
FIG. 2 is a perspective view showing the exterior of a cassette.

The aforementioned cassette 11 is equipped with: a top cover 11' having its upper surface open in the paper feeding direction, as shown in FIG. 2, and a pair of pawls 18 for lightly supporting the two sides of the leading end of an uppermost recording paper so as to feed out the recording paper sheet by sheet without fail. The cassette 11 is further equipped with thin sheets 19 for covering the aforementioned pawls 18 so that the manual insertion can be made by making use of its top cover 11'. The top cover 11' is equipped with a guide plate 20 which is made movable in the widthwise direction so as to determine the size of the papers to be manually inserted.

Figure 3:
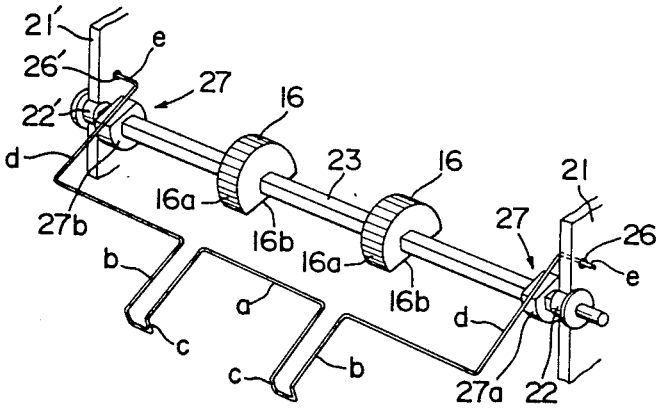
FIG. 3 is a perspective view showing a paper feed roller and a shutter.

The two paper feed rollers 16 are fixed, as shown in FIG. 3, at a central portion of a square shaft 23 supported through bearing members 22 and 22' by opposed frames 21 and 21' of the body 1 and have their circumference cut away partially into a semicircular shape. When the paper is not fed, moreover, each of the paper feed rollers 16 has its round portion **16*a* directed upward and its cut-away portion 16*b* directed downward so that a passage 24 for a paper 15' inserted manually can be established between the cut-away portion 16*b* and the recording paper 15 raised by the push-up level 13**, as has been described hereinbefore.

Figure 4A:
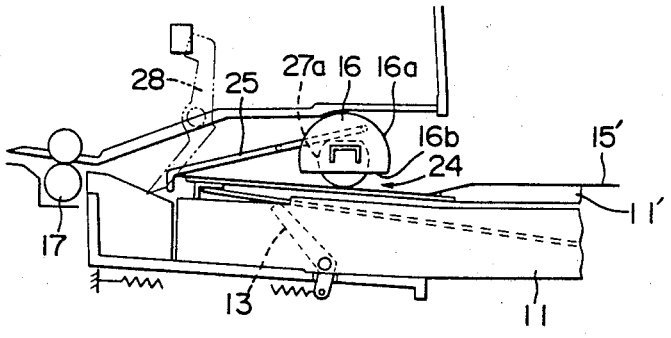
FIGS. 4(A), 4(B) and 4(C) are sectional views showing the operations of the paper feed rollers and the shutter.
Figure 4B:
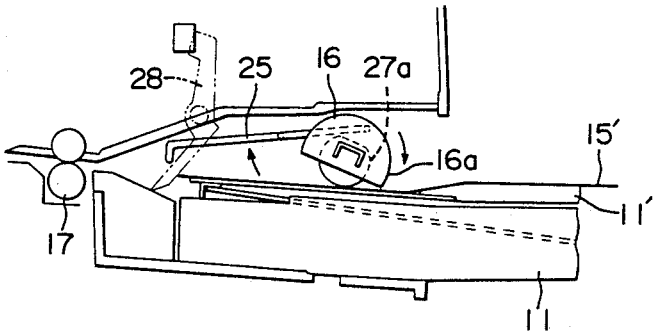
Figure 4C:
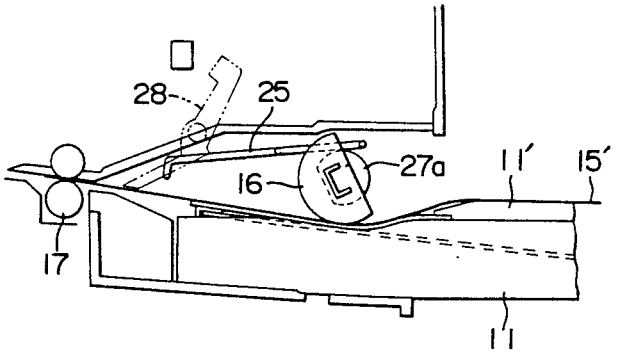

Denoted at reference numeral 25 is a leading end regulating shutter which is disposed downstream of the aforementioned passage 24 for regulating the leading end of the paper 15' to be manually inserted. The shutter 25 is constructed, as shown in FIG. 3, by bending a linear material into a groove shape, forming two pulse-wave-shaped projecting portions b and b at the central portion a of the groove shape, forming L-shaped hook portions c and c at the leading ends of the projecting portions b and b, bending the end portions of the groove-shaped two sides d and d, and inserting the bent ends e and e into holes 26 and 26' which are formed at rear obliquely upper portions of the bearing portions of the square shaft 23 of the aforementioned paper feed rollers 16. Reference numerals 27 denotes energizing means associated with the action of the paper feed rollers 16 for causing the shutter 25 to escape before the start of the paper feed. Said energizing means 27 has its cams 27*a* and 27*b* secured to the two end portions of the square shaft 23. The two side portions d and d of the shutter 25 bear on respective cams 27*a*, 27*b*. Cams 27*a* and 27*b* also have a semicircular shape but are inverted from the paper feed rollers 16. When the paper feed rollers 16 have their round portions 16*a* directed upward while they are inoperative, the aforementioned cams 27*a* and 27*b* have their cut-away portions directed upward so that the shutter 25 (or the L-shaped hook portions c and c) shuts off the passage 24. As a result, the shutter 25 blocks the leading end of the paper 15' inserted manually, as shown in FIG. 4(A). On the other hand, the paper feed rollers 16 start their rotations, as indicated by an arrow in FIG. 4(B), so that the leading ends of their round portions 16*a* taken in the rotational direction come into contact with the manually inserted paper 15' to start the paper feed. Immediately after the rotations of the paper feed rollers 16, however, the round portions of the aforementioned cams 27*a* and 27*b* raise the two side portions d and d of the shutter 25, as indicated by an arrow in FIG. 4(B). As a result, at the start of the paper feed, the shutter 25 escapes above the passage 24 so that the manually inserted paper 15' is fed into the second paper feed rollers 17, as shown in FIG. 4(C).

Reference numeral 28 denotes paper feed detecting means.

As has been described hereinbefore, the present invention is characterized by providing: a passage for a manually inserted paper formed below a paper feed roller; a leading end regulating shutter disposed downstream of said passage for regulating the leading end of said manually inserted paper; and bias means associated with the operation of said paper feed rollers for causing said shutter to escape before the paper feed. As a result, when in the manual insertion mode, the manually inserted paper can be deeply inserted below the paper feed rollers without being obstructed by the recording papers which are stacked in the cassette and raised by the push-up lever. Moreover, the inserted position of the manually inserted paper is always maintained by the leading end regulating shutter. Since this shutter escapes outside of the passage before the start of the paper feed, still moreover, the manually inserted paper can be prevented from becoming short of insertion and being disabled to be fed so that it can always be fed without fail.

What is claimed is:

1. In an image reproducing apparatus having an automatic paper feed function and a manual paper feed function, the improvement comprising the combination of:

a paper tray for holding a plurality of papers which are to be automatically fed from said paper tray on a one-by-one basis;

paper feed rollers mounted above said paper tray for selectively feeding papers from said paper tray;

a passage for receiving a manually inserted paper formed between said paper tray and said paper feed rollers;

a leading end regulating shutter at least partially disposed above said paper tray and downstream of said passage for regulating the leading end of said manually inserted paper;

operating means coupled to said paper feed rollers for operating said paper feed rollers to feed paper out from said paper tray; and energizing means coupled to said operating means and being operable in association with the operation of said paper feed rollers for causing said shutter to escape to clear said passage for said manually inserted paper before said manually inserted paper is fed by said paper feed rollers, to thereby permit said manually inserted paper to be manually fed past said paper feed rollers before being fed into said reproducing apparatus by said paper feed rollers.

2. A reproducing apparatus according to claim 1, wherein said paper feed rollers have a substantially semicircular shape.

3. A reproducing apparatus according to claim 2, wherein:

said operating means includes a shaft on which said paper feed rollers are mounted;

said energizing means includes substantially semicircular cams mounted on said shaft on which said paper feed rollers are mounted; and said substantially semicircular cams are inverted in position relative to said paper feed rollers.

4. A reproducing apparatus according to claim 3, wherein said substantially semicircular cams and said substantially semicircular paper feed rollers are mounted on said shaft such that when the substantially semicircular portions of said substantially semicircular cams face upward, said substantially semicircular portions of said paper feed rollers face downward.

5. A reproducing apparatus according to claim 1, wherein said regulating shutter includes at least one projecting member projecting in the direction of feed of said papers, said at least one projecting member having blocking means for selectively blocking said passage downstream of said paper feed rollers.

6. A reproducing apparatus according to claim 5, wherein said blocking means blocks said passage in the vicinity of the leading end of said paper tray in the direction of feed of said paper.

7. A reproducing apparatus according to claim 1, wherein said leading end regulating shutter is a member formed of linear material having two pulsewave-shaped projecting portions for regulating the leading end of said manually inserted paper.

8. In an image reproducing apparatus having an automatic paper feed function and a manual paper feed function, the improvement comprising the combination of:

a paper tray for holding a plurality of papers which are to be automatically fed from said paper tray on a one-by-one basis;

paper feed means mounted on a rotatable shaft above said paper tray for selectively feeding papers from said paper tray, said paper feed means having a cut-away portion to form a gap between said paper tray and said cut-away portion through which paper can be manually inserted when a paper feed operation is not being conducted;

a leading end regulating member at least partially disposed above said paper tray and downstream of said gap for regulating the leading end of said manually inserted paper;

means coupled to said rotatable shaft for rotating said rotatable shaft to cause said paper feed means to feed paper out from said paper tray; and energizing means mounted on said rotatable shaft and being operatively coupled to said leading end regulating member, said energizing means being operable responsive to rotation of said rotatable shaft for moving said leading end regulating member to clear a feed path for said manually inserted paper after insertion of said manually inserted paper and before said manually inserted paper is fed by said paper feed means, to thereby permit said manually inserted paper to be manually fed past said paper feed means before being fed into said reproducing apparatus by said paper feed means.

9. A reproducing apparatus according to claim 8, wherein said energizing means comprises at least one cam.

10. A reproducing apparatus according to claim 8, wherein said paper feed means comprises at least one substantially semicircular paper feed roller having a substantially circular portion and said cut-away portion.

11. A reproducing apparatus according to claim 10, wherein said energizing means comprises at least one substantially semicircular cam having a cut-away portion, said cut-away portion being inverted from said cut-away portion of said at least one paper feed roller.

12. A reproducing apparatus according to claim 8, wherein said rotatable shaft has a substantially rectangular cross section except at its end portions, at least both end portions of said rotatable shaft being substantially circular in cross-section.

13. A reproducing apparatus according to claim 8, wherein said leading end regulating member is a member formed of linear material having two pulsewave-shaped projecting portions for regulating the leading end of said manually inserted paper.

14. In an image reproducing apparatus having a manual paper feed function, the improvement comprising the combination of:

paper feed rollers for selectively feeding papers into said image reproducing apparatus, said paper feed rollers having a substantially semicircular shape;

a passage for receivig a manually inserted paper formed below said paper feed rollers;

a leading end regulating shutter at least partially disposed downstream of said paper feed rollers and downstream of said passage for regulating the leading end of said manually inserted paper;

operating means coupled to said paper feed rollers for operating said paper feed rollers to feed paper;

energizing means operable responsive to operation of said operating means and being operable in association with the operation of said paper feed rollers for causing said shutter to escape to clear said passage for said manually inserted paper before said manually inserted paper is fed by said paper feed rollers, to thereby permit said manually inserted paper to be manually fed past said paper feed rollers before being fed into said reproducing apparatus by said paper feed rollers; and said energizing means including at least one substantially semicircular cam, said substantially semicircular cam being inverted in position relative to said paper feed rollers.

15. A reproducing apparatus according to claim 14, wherein:

said operating means includes a shaft on which said paper feed rollers are mounted; and said at least one substantially semicircular cam is mounted on said shaft on which said paper feed rollers are mounted.

16. A reproducing apparatus according to claim 15, wherein said energizing means includes a plurality of said substantially semicircular cams, and wherein said substantially semicircular paper feed rollers are mounted on said shaft such that when the substantially semicircular portions of said substantially semicircular cams face upward, said substantially semicircular portions of said paper feed rollers face downward.

17. A reproducing apparatus according to claim 14, wherein said regulating shutter includes at least one projecting member projecting in the direction of feed of said papers, said at least one projecting member having blocking means for selectively blocking said passage downstream of said paper feed rollers.

18. A reproducing apparatus according to claim 17, wherein said blocking means blocks said passage in the vicinity of the leading end of said papers in the direction of feed of said paper.

19. A reproducing apparatus according to claim 14, further comprising a paper tray arranged below said paper feed rollers, said manual feed passage being formed between said paper tray and said paper feed rollers.

20. A reproducing apparatus according to claim 14, wherein said leading end regulating shutter is a member formed of linear material having two pulsewave-shaped projecting portions for regulating the leading end of said manually inserted paper.

* * * * *